US005964132A

United States Patent [19]

Chen

[11] Patent Number: 5,964,132

[45] Date of Patent: Oct. 12, 1999

[54] MULTI-FUNCTION UTILITY TOOL

[75] Inventor: Liu Kuo Chen, Ta Li, Taiwan

[73] Assignee: ICC Innovative Concepts Corp., Torrington, Conn.

[21] Appl. No.: 08/880,825

[22] Filed: Jun. 23, 1997

[30] Foreign Application Priority Data

Jun. 24, 1996 [TW] Taiwan ..... 85209452
Aug. 29, 1996 [CN] China ..... 96 2 30597

[51] Int. Cl.[6] ..... B25B 23/00

[52] U.S. Cl. ..... 81/439; 81/177.2

[58] Field of Search ..... 81/177.2, 177.4, 81/177.6, 437–439

[56] References Cited

U.S. PATENT DOCUMENTS

| | | | |
|---|---|---|---|
| 138,528 | 5/1873 | Reed et al. . | |
| 814,020 | 3/1906 | Clifford . | |
| 1,689,376 | 10/1928 | Zilliox . | |
| 1,820,819 | 8/1931 | Meyer . | |
| 2,632,489 | 3/1953 | Johnson . | |
| 2,674,286 | 4/1954 | Carson . | |
| 2,682,414 | 6/1954 | Richardson . | |
| 2,730,145 | 1/1956 | Brown | 81/437 X |
| 2,821,724 | 2/1958 | Wurgaft . | |
| 3,034,550 | 5/1962 | Dahl . | |
| 3,255,792 | 6/1966 | Beck . | |
| 3,319,676 | 5/1967 | Belanger . | |
| 4,328,721 | 5/1982 | Massari . | |
| 4,336,729 | 6/1982 | Eppenbach | 81/437 X |
| 4,409,866 | 10/1983 | McBride . | |
| 4,581,961 | 4/1986 | Lai . | |
| 5,427,003 | 6/1995 | Boltak et al. . | |
| 5,450,775 | 9/1995 | Kozak . | |
| 5,458,030 | 10/1995 | Betts . | |

FOREIGN PATENT DOCUMENTS

| | | | |
|---|---|---|---|
| 160231 | 3/1933 | Switzerland | 81/439 |

*Primary Examiner*—James G. Smith
*Attorney, Agent, or Firm*—Handal & Morofsky

[57] ABSTRACT

A multi-purpose utility tool, having a handle, a shaft and a locking and release mechanism. The handle defines a centrally located opening. The shaft has a first end and a second end and is to be slidably positioned within said centrally located opening. The locking and release mechanism locks the handle upon the shaft in first position and a second position. The first position allows the first end to be exposed for use while the second end is secured within the handle. The second position allows the second end to be exposed for use while the first end is secured within the handle. A handle stop portion extends from the handle towards the shaft. A shaft stop member extends outwardly from the shaft. The handle stop portion allows the shaft stop member and the shaft to be slidably positioned between a pair of limits of movement. The limits of movement include the first and second locking positions.

19 Claims, 14 Drawing Sheets

MULTI-FUNCTION UTILITY TOOL

This application claims priority from Chinese patent application Ser. No. 96230597.9 filed Aug. 29, 1996 and from Taiwan patent application Ser. No. 85209452 filed Jun. 24, 1996 the disclosures of which are hereby incorporated herein by reference thereto.

TECHNICAL FIELD

The present invention relates to a screwdriver tool for providing a dual purpose function without having to supply alternative screwdrivers or screwdriver tips. The present invention relates to a combination screwdriver featuring two different ends protruding from a single handle. The handle may be locked onto either end to provide two tools in one, minimizing the number of tools required to be carried by an individual. In addition, the present invention allows for single handed operation of the multi-function tool.

BACKGROUND

In the past, much effort has been devoted to the development of utility tool devices. The desirable qualities of such a device fall into several categories including safety, reliability, durability, versatility and convenience of use.

Carson (U.S. Pat. No. 2,674,286) is directed to a retractable tool with a double ended shank. However, a disadvantage of the device of the Carson patent is that the tool disclosed has a single side locking design and does not prevent the shaft from completely sliding out from the handle. This design is not effectually advantageous to the user as it is not stable.

Johnson (U.S. Pat. No. 2,612,489) discloses a retractable tool with a handle. However, a disadvantage of the Johnson patent is that the tool disclosed has a shaft that must be grasped by the user and pulled towards him in order to release the locking mechanism. This mechanism is simply not an efficient means for unlocking the shaft from the handle. Johnson's locking means also does not provide a stable means for securing the handle to the shaft of the tool. The parts protruding from the shaft may cause difficulty in operation.

Zilliox (U.S. Pat. No. 1,689,376) discloses a multi bit tool with a clamping screw which is loosened or tightened to expose a screwdriver tip for use. A disadvantage of Zilliox's invention requires another tool to manipulate the clamping mechanism. Also, Zilliox clamping mechanism is cumbersome to use and over time the threads on the screws may wear causing structural damage to the locking mechanism.

Clifford (U.S. Pat. No. 814,020) discloses a screwdriver with a double ended shaft. However, similar to Zilliox, Clifford also discloses a screw mechanism which is cumbersome to use and over time the threads on the screws may also wear causing inefficient operation of the tool.

The available tools, such as those noted above, provide varying degrees of dual operation. This feature however, is gained at the expense of versatility and convenience. In accordance with the present invention, these and other disadvantages of the prior art are minimized. The present invention provides a high degree of fail-safe operation of a dual function tool while remaining versatile and convenient to use.

SUMMARY OF THE INVENTION

The invention, as claimed, is intended to provide a remedy. It solves the problem of how to provide a reliable, convenient and consistent way of utilizing a dual function screwdriver type tool. The present invention allows a user to conveniently place and lock the screwdriver handle at either end of the screwdriver shaft while exposing either one of two screwdriver tips.

The inventive utility tool comprises a screwdriver shaft having alternative screwdriver tips and a slidably mounted handle. The handle is lockable in one of two positions for exposing either end of the shaft.

The configuration of the inventive utility tool allows the handle to slide and lock on either end of the shaft while exposing a screwdriver tip for use. The positioning of the release mechanism of the present invention requires only one hand of a user to lock or unlock the handle.

In addition, the release mechanism of the present invention is recessed within the handle of the tool so that the handle cannot be accidentally released from its locked position while being used.

Alternatively, this feature allows for convenient placement of the handle at either end of the shaft. The ease of placement reduces the need to use multiple tools and/or tool bits. Moreover, the quick release locking mechanism is extremely durable and is easily accessible. The locking mechanism allows for effortless operation. Once released, a user may simply tilt the tool until gravity causes the shaft to slide through the handle and lock in its alternative position. No tools are required to unlock and slide the handle along the shaft of the tool.

In adverse weather conditions, such as freezing temperatures, the convenience of the utility tool is fully utilized. The user may operate the either end of the tool while wearing bulky gloves. Also, the recessed release mechanism prevents accidental unlocking.

In contrast to Carson, the dual locking feature of the present invention provides the user with a more stable locking mechanism. Also, the present invention prevents the shaft from completely sliding out from the handle when in use.

As illustrated in the drawings, the inventive utility tool offers many advantages over other similar tools. It is made from a plurality of parts which can be easily assembled. More particularly, the inventive feature of a quick release locking mechanism and the recessed feature of the release mechanism allows convenient and safe operation of the utility tool. This aspect causes the present invention to be far superior than previous tools of a similar nature.

BRIEF DESCRIPTION OF THE DRAWINGS

One way of carrying out the invention is described in detail below with reference to drawings which illustrate a specific embodiment of the invention.

DETAILED DESCRIPTION OF THE PREFERRED EMBODIMENTS

Figure 1A:
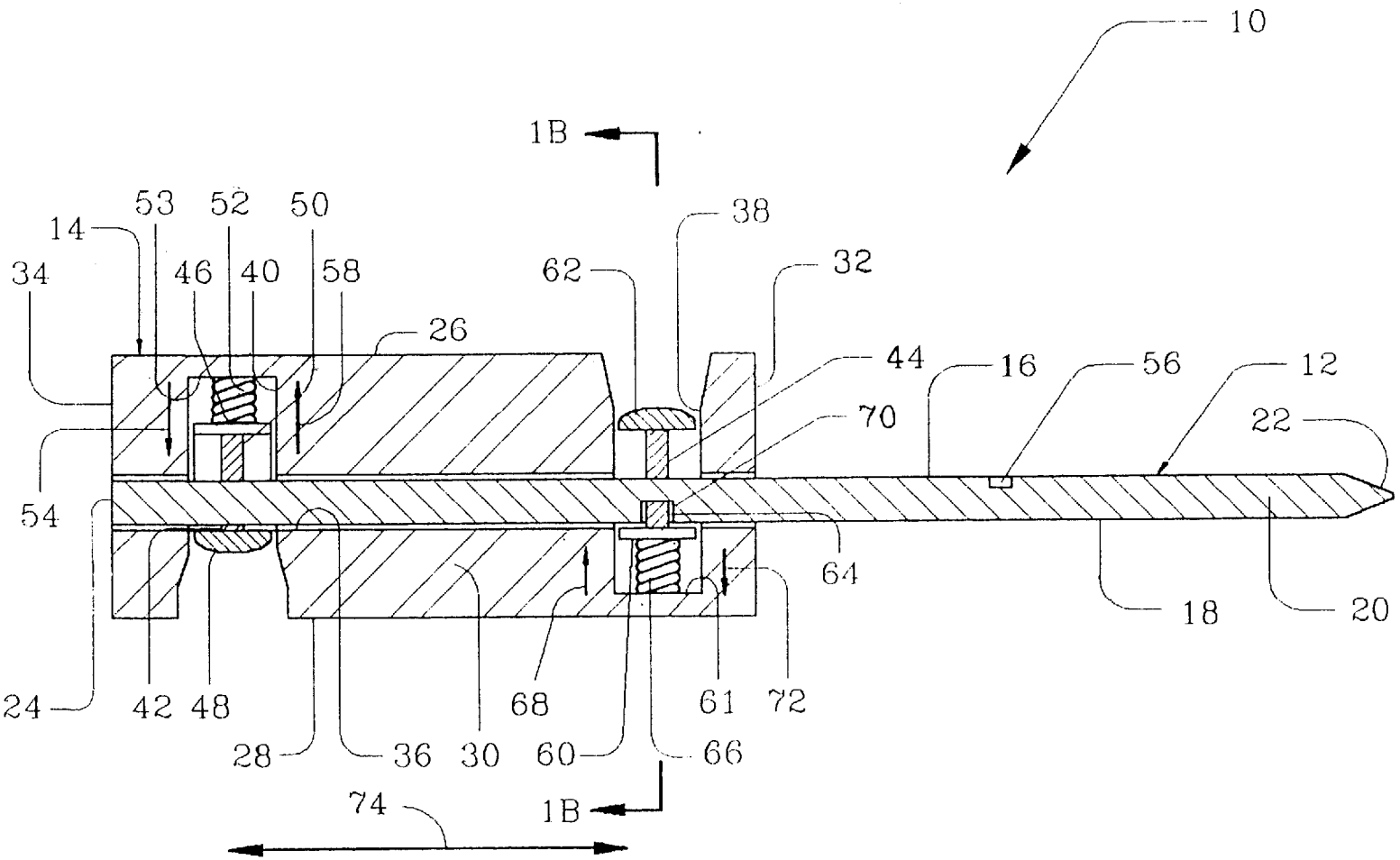
FIG. 1A is a cross sectional view of the inventive utility tool.

Referring to FIG. 1, the inventive multi-purpose tool is illustrated. Tool 10 comprises a shaft 12 and a handle 14. Shaft 12 is preferably made of metal of other high tensile strength material. In this embodiment, shaft 12 has a rectangular cross section. Shaft 12 has an upper surface 16, a lower surface 18 and a pair of longitudinal sides 20.

Shaft 12 terminates in a contact end 22 at one end and a second contact end 24 at the opposite end. In this embodiment a Phillips' head screwdriver tip is disposed on contact end 22 while a flat head screwdriver tip is disposed on contact end 24. Alternatively, one or both of the ends may terminate in a hex wrench, socket wrench or mounting structure for a tip of any desired function.

Similarly, handle 14 has an upper surface 26, a lower surface 28 and a pair of longitudinal sides 30. The surfaces 26, 28, and 30 of handle 14 may be configured with a grooves 31 to provide for an optimum gripping surface of handle 14 as illustrated in phantom lines in FIG. 1C. Handle 14 may also be manufactured out of a high strength plastic or any other easily molded material that provides a light weight durable construction.

Alternatively, and for industrial uses, handle 14 may be constructed from super strong materials such as hardened steel.

Handle 14 also terminates at a pair of ends 32 and 34. An opening 36 is centered on ends 32 and 34 and runs completely through handle 14. In this embodiment, opening 36 is generally rectangular in shape and is of a slightly larger caliber than shaft 12. This allows shaft 12 to be slidably mounted in handle 14. The positioning of opening 36 allows handle 14 to be centered on shaft 12.

The centering of handle 14 on the corresponding shape of opening 36 and shaft 12 provides an optimum transfer of torsional force from handle 14 to shaft 12. When a torsional force is applied by the hand or hands of a user to handle 14, shaft 12 is rotated. Similarly, a torsional force may also be applied by a wrench, pneumatic tool or other mechanical device.

In addition, the corresponding shape of opening 36 with respect to shaft 12 prevents wobbling of the shaft when in use.

Shaft 12 and opening 36 may also be manufactured in other shapes such as a hexagonal, star and/or Allen wrench type. These shapes will also provide an efficient transfer of force.

Handle 14 also has a pair of openings 38 and 40 extending into and through opening 36. Opening 38 is disposed in upper surface 26 while opening 40 is disposed in lower surface 28. Seated within openings 38 and 40 are a pair of rectangular button frames 42 and 44.

Openings 38 and 40 are configured to allow button frames 42 and 44 to be slidably positioned with openings 38 and 40 while allowing shaft 12 to pass through holes 45 in button frames 42 and 44.

Button frames 42 and 44 are slightly smaller than openings 38 and 40. This allows button frames 42 and 44 to be slidably positioned in openings 38 and 40 and also be recessed from the surfaces of handle 14.

Button frame 42 has an engagement end 46, a release button surface 48 which the user presses to disengage it and an engagement pin 50. Engagement pin 50 is preferably constructed of a hardened material to reduce wear of pin 50. A spring 52 is positioned between engagement end 46 and the bottom 53 of opening 40. Spring 52 provides an urging force upon frame 42 causing it to move in the direction of arrow 54.

When engagement pin 50 is positioned over opening 56 pin 50 becomes seated within opening 56 and locks handle 14 onto shaft 12 at a fixed position.

Engagement pin 50 is slightly smaller than opening 56. This allows pin 50 to be snugly seated within opening 56. Once pin 50 is seated within opening 56, handle 14 is locked on shaft 12 in a position that exposes end 24 for use while end 22 is recessed within opening 36.

To release this locking position a user may simply depress release button surface 48 of button frame 42 until a force sufficient to overcome the urging force of spring 52 reached. Once the urging force of spring 52 is overcome, button frame 42 will move in the direction of arrow 58. The configuration of opening 40 allows button frame 42 to move in the direction of arrow 58 until engagement pin 50 is retracted from opening 56.

Similarly, button frame 44 has an engagement end 60, a release button surface 62 and an engagement pin 64. A spring 66 is positioned between engagement end 60 and the bottom 61 of opening 38. Spring 66 provides an urging force upon frame 44 causing it to move in the direction of arrow 68 when engagement pin 64 is positioned over opening 70 on shaft 12. Engagement pin 64 is slightly smaller than opening 70. This allows engagement pin 64 to be snugly seated within opening 70.

Figure 1C:
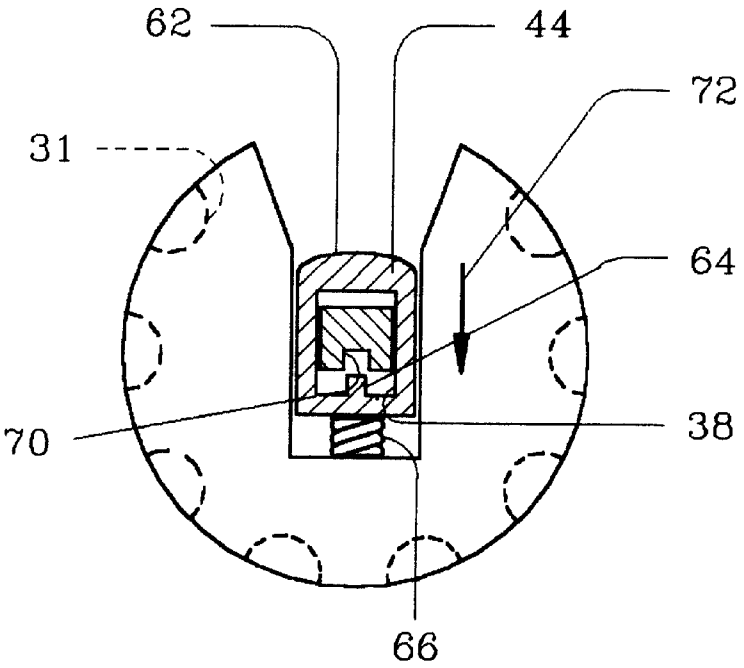
FIG. 1C is a cross sectional view illustrating the movement of the locking mechanism of the present invention.
Figure 1B:
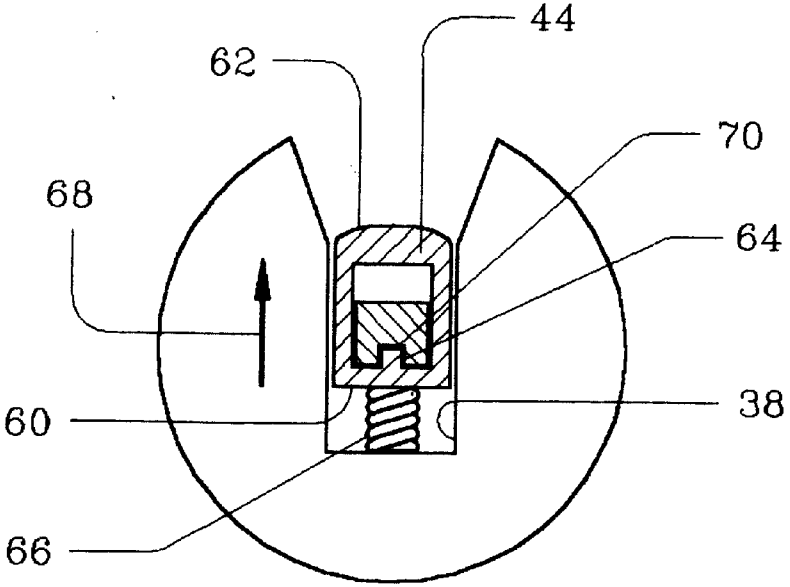
FIG. 1B a cross sectional view along line 1B.

Referring now to FIG. 1B, once pin 64 is seated within opening 70, handle 14 is now locked upon shaft 12 in a position that exposes contact end 22 for use while contact end 24 is recessed within opening 36.

As shown in FIG. 1C, to release this locking position a user may simply depress release button surface 62 of button frame 44 until a force sufficient to overcome the urging force of spring 66 is reached. Once the urging force of spring 66 is overcome button frame 44 will move in the direction of arrow 72. The configuration of opening 38 allows button frame 44 to move in the direction of arrow 72 until engagement pin 64 is completely retracted from opening 70.

Figure 1E:
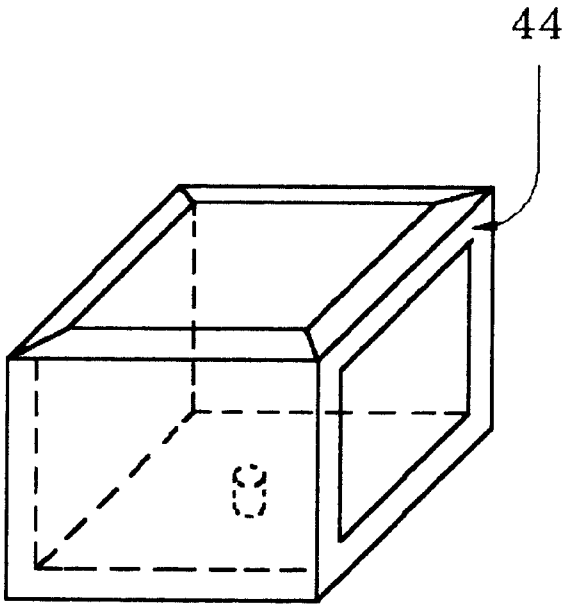
FIG. 1E is a perspective view of the locking mechanism of an alternative embodiment of the FIG. 1A embodiment.
Figure 1D:
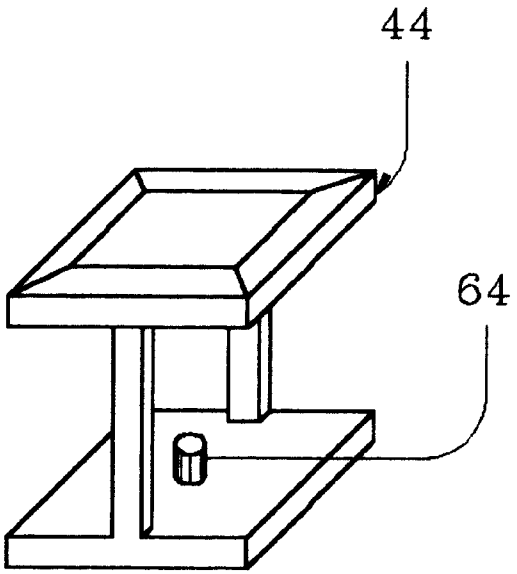
FIG. 1D is a perspective view of the locking mechanism of the FIG. 1A embodiment.

Referring now to FIG. 1D, the structural configuration of button frames 42 and 44 is illustrated. Alternatively, button frames 42 and 44 may be configured to have a sleeve type configuration as shown in FIG. 1E.

Referring back now to FIGS. 1A–C, the inner surface of opening 38 is chamfered. The chamfering of opening 38 allows convenient access of release button surface 62 of button frame 44. The chamfering of opening 38 also allows release button surface 62 of button frame 44 to be recessed into opening 38 at all times. This feature allows a user to grip handle 14 and use tool 10 without interference from the locking mechanism of tool 10. Similarly, opening 40 is also chamfered.

This feature is of particular importance when the inventive tool is in use. The recessed feature of release button surfaces 62 and 48 prevents inadvertent slippage of handle 14 on shaft 12. Handle 14 cannot be accidentally unlocked from shaft 12. This recessed feature reduces the risk of this occurrence.

The inventive feature of the present invention also allows handle 14 to slide in the directions illustrated by arrows 74 when either release button surface 62 or 46 is depressed to release handle 14 from its locking position on shaft 12.

Once released, a user can slide shaft 12 through handle 14 or simply tilt tool 10 until gravity causes shaft 12 to slide through handle 14 until shaft 12 locks in its alternative position. Alternatively, the end being retracted may be pushed against an object, this feature allows single handed operation of tool 10. This feature is of particular importance when a user is working from a ladder and/or scaffolding.

Figure 2:
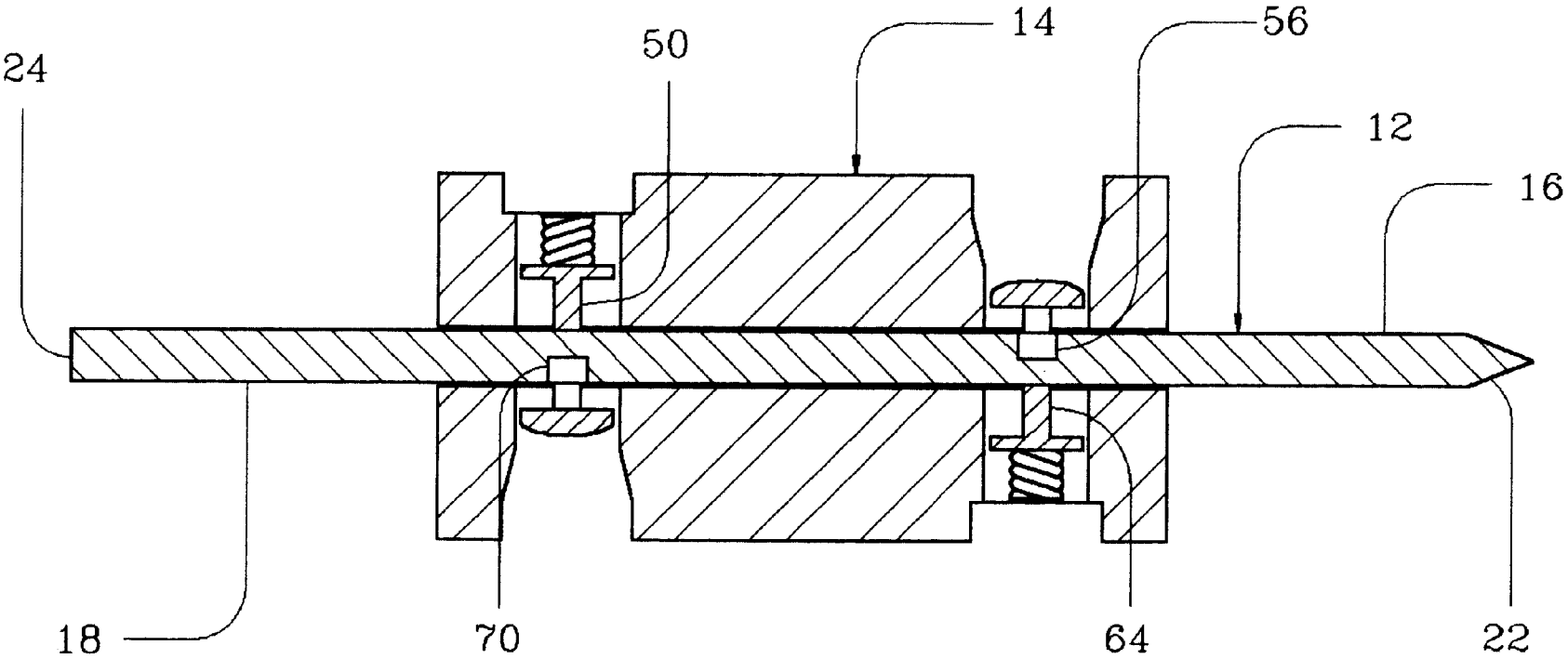
FIG. 2 is a cross sectional view of the utility tool in transition from one configuration to another.

Referring now to FIG. 2, handle 14 can be slidably positioned on shaft 12 without engagement pins 50 and 64 locking handle 14 in place. This is achieved by positioning openings 56 and 70 on opposite sides of shaft 12, namely upper surface 16 and lower surface 18. This positioning of openings 56 and 70 ensures that handle 14 will only lock onto shaft 12 when ends 22 and 24 are positioned properly with respect to handle 14 thereby providing for optimum use.

Figure 3:
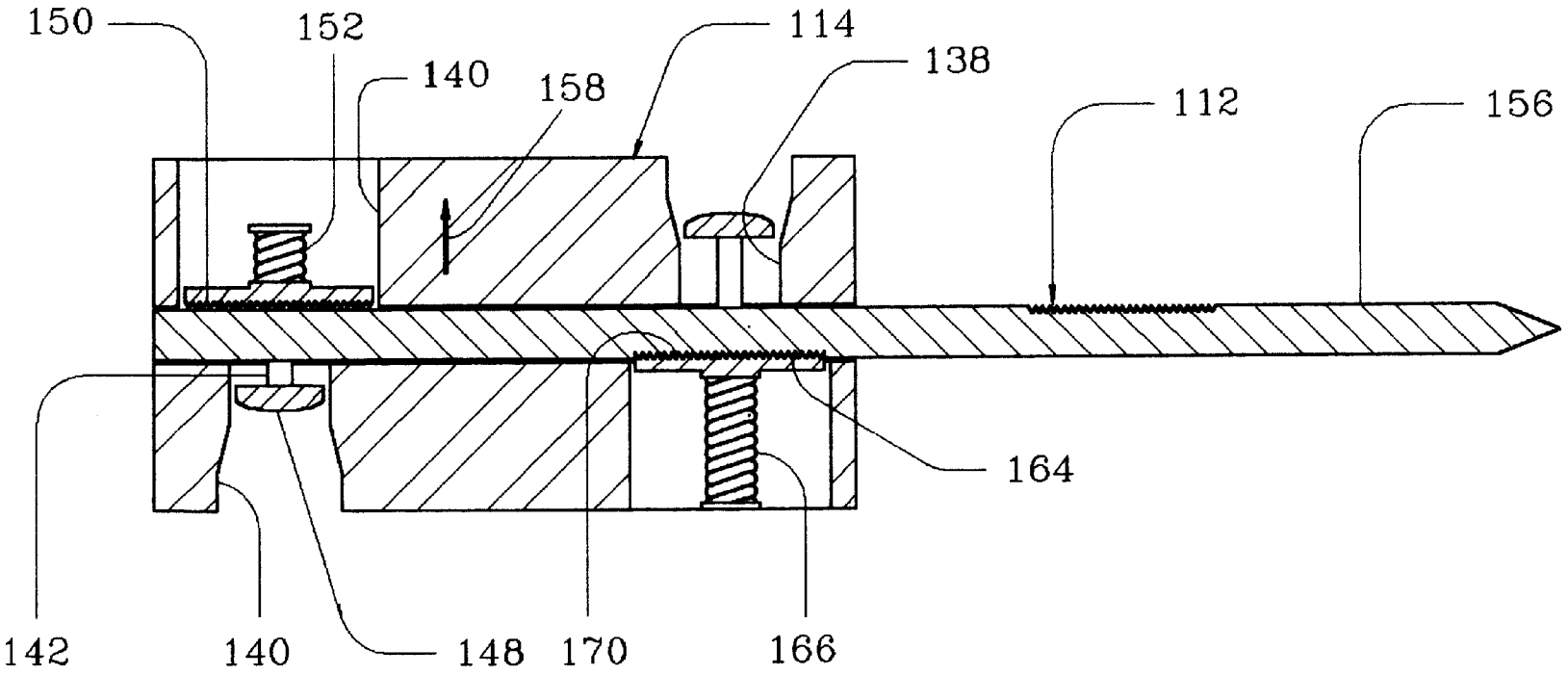
FIG. 3 is a cross sectional view of an alternative embodiment of the present invention.

In FIG. 3, an alternative embodiment of the present invention is illustrated. Generally similar components or parts performing analogous, corresponding or identical functions to those of the FIG. 1 embodiment are numbered herein with numerals which differ from the FIG. 1 embodiment by multiples of one hundred.

Referring to FIG. 3, a handle 114 provides an alternative locking mechanism for the present invention. A shaft 112 has a pair of grooved openings 156 and 170 which are provided with uniform teeth that when aligned with a pair of matching engagement teeth 150 and 164, results in handle 114 being again locked into position. Engagement teeth 150 and 164 are configured to mate with matching teeth positioned in openings 156 and 170 on shaft 112.

In this embodiment a pair of openings 138 and 140 are positioned on handle 214. Openings 138 and 140 are sized to accommodate engagement teeth 150 and 164. Engagement teeth 150 and 164 provide an elongated surface for accommodating the frictional securement of engagement teeth 150 and 164 to teeth positioned in openings 156 and 170.

To provide a uniform force along the entire surface of engagement teeth 150 and 164, a pair of springs 152 and 166 having an elongated surface and are positioned between the bottom of openings 138 and 140 and engagement teeth 150 and 164. Springs 152 and 166 are of a heavy gage and provide an urging force upon engagement teeth 150 and 164.

To release tool 110 from the locked position a user may simply depress a release button surface 148 of a button frame 142 until a force sufficient to overcome the urging force of spring 152 reached. Once the urging force of spring 152 is overcome, button frame 142 will move in the direction of arrow 158. The configuration of opening 140 also allows button frame 142 to move in the direction of arrow 158 until engagement teeth 150 are retracted from grooved opening 156.

Figure 4:
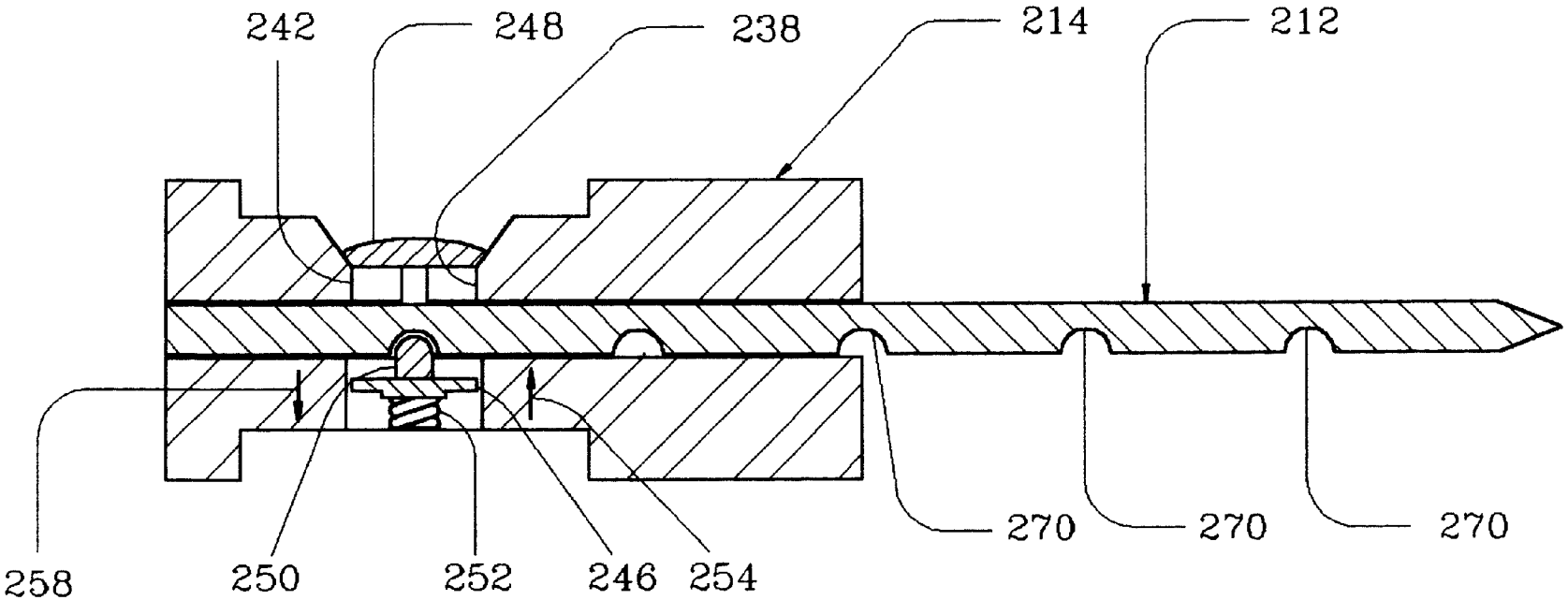
FIG. 4 is a cross sectional view of another alternative embodiment of the present invention.

Referring now to FIG. 4, another alternative embodiment is illustrated. Here a shaft 212 is provided with a series of spaced receptacles 270. Receptacles 270 provide alternative locking positions of a handle 214 on shaft 212.

Handle 214 has an opening 238. Opening 238 is disposed of on upper surface 226 of handle 214. Seated within opening 238 is a rectangular button frame 242. Opening 238 is configured to allow button frame 242 to be positioned within opening 238 while allowing shaft 212 to pass through the center of button frame 242. Button frame 242 is slightly smaller than opening 238. This allows button frame 242 to be slidably positioned in opening 238 and also be recessed within handle 214.

Button frame 242 is also provided with an engagement end 246, a release button surface 248 and an engagement pin 250. A spring 252 is positioned between engagement end 246 and the bottom of opening 238. Spring 252 provides an urging force upon button frame 242 causing it to move in the direction of arrow 254 when engagement pin 250 is positioned over openings 270 on shaft 212.

Engagement pin 250 is slightly smaller than receptacles 270. This allows pin 250 to be snugly seated within receptacles 270. Once pin 250 is seated within one of the receptacles 270, handle 214 is locked on shaft 212 in a position that exposes either end 224 or 222 or for adjusting the length of shaft 212.

The feature provides for a dual headed utility tool that may also provide a short shafted screwdriver while alternatively supplying an elongated screwdriver shaft.

To release this locking position of handle 214 a user may simply depress release button surface 248 of button frame 242 until a force sufficient to overcome the urging force of spring 252 reached. Once the urging force of spring 252 is overcome button frame 242 will move in the direction of arrow 258. The configuration of opening 238 allows button frame 242 to move in the direction of arrow 258 until engagement pin 250 is retracted from opening 270.

Figure 5:
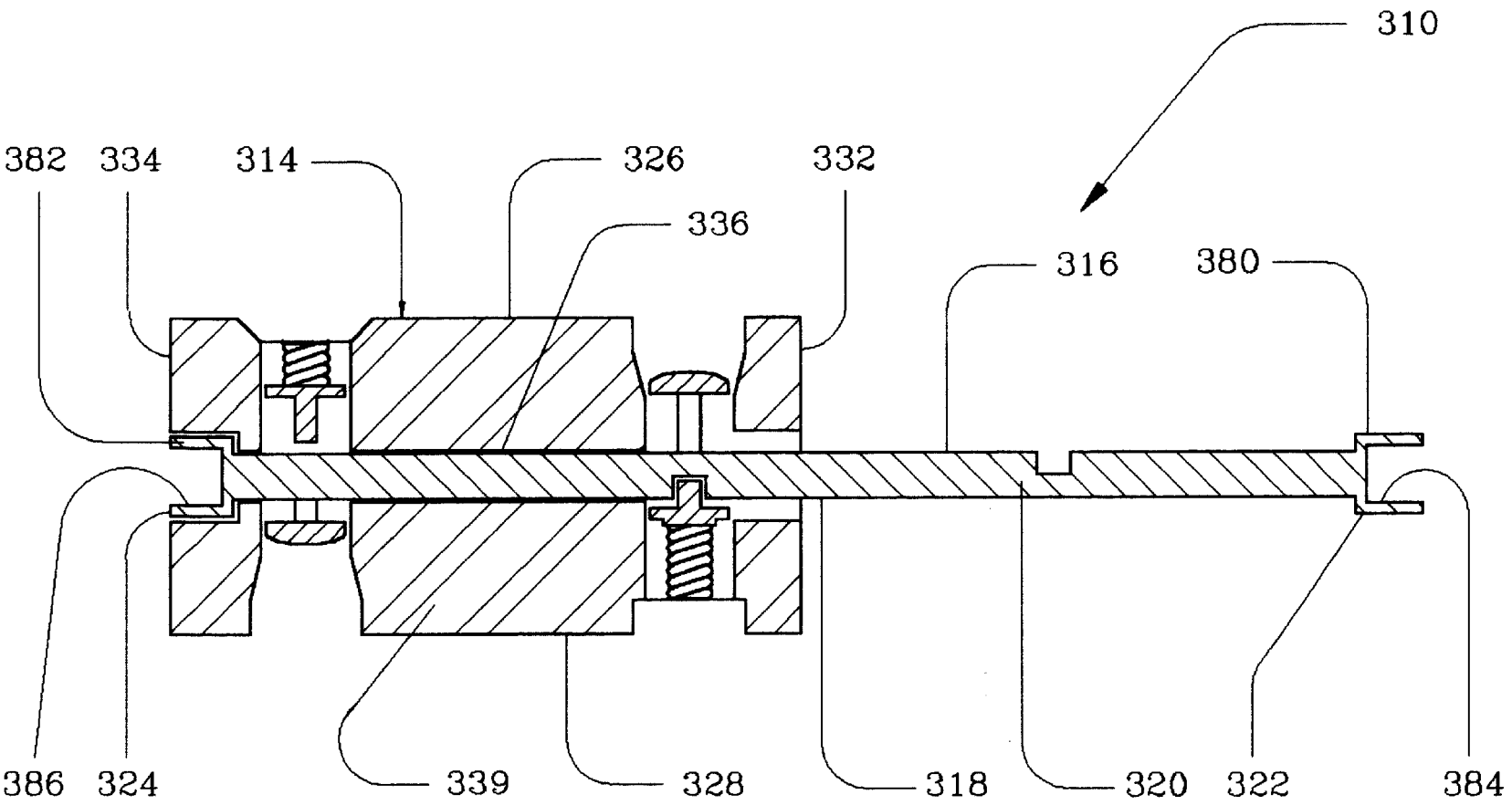
FIG. 5 is a cross sectional view of yet another alternative embodiment of the present invention.

Referring now to FIG. 5, yet an another alternative embodiment is illustrated. In this embodiment a multipurpose utility tool 310 is illustrated. Tool 310 comprises a shaft 312 and a handle 314. Shaft 312 has an upper surface 316, a lower surface 318 and a pair of longitudinal sides 320. Shaft 312 terminates in a contact end 322 at one end and a second contact end 324 at the opposite end. In this embodiment contact end 322 is provided with a socket attachment while contact end 324 has an alterative socket attachment. End 322 may be provided with a ½ inch socket while end 324 may be provided with the next size smaller or larger socket, such as ⅝ inch or 7/16 inch socket. Alternatively, ends 322 and 324 may be provided with metric sockets ends or an Allen wrench attachment or a Star wrench attachment.

Similarly, handle 314 has an upper surface 326, a lower surface 328 and a pair of longitudinal sides 330. Handle 314 also terminates at a pair of ends 332 and 334. An opening 336 is centered on ends 332 and 334 and runs completely through handle 314. Opening 336 is generally rectangular in shape and has a perimeter slightly larger that the perimeter of shaft 312. This allows handle 314 to be slidably mounted over shaft 312. The positioning of opening 336 allows handle 314 to be centered on shaft 312.

Opening 336 is significantly larger than shaft 312 at ends 332 and 334. The increased size of opening 336 is configured to allow the recessed securement of a pair of socket heads 380 and 382. Heads 380 and 382 are permanently fastened to shaft 312. Heads 380 and 382, are configured to have an internal socket opening 384 and 386. Openings 384 and 386 are sized to accommodate a nut to be removed.

Alternatively, socket heads 380 and 382 may be replaced with Allen wrench attachments, Star driver attachments and any other commercially available fastening device. In addition, shaft 312 may be configured so that socket heads 380 and 382 can be removably secured to shaft 312 thereby allowing for the alternative sizing of the socket heads to be used.

Moreover, shaft 312 may be sized to accommodate different types of removable sockets such as ¼ inch socket or ⅜ inch socket.

Figure 6:
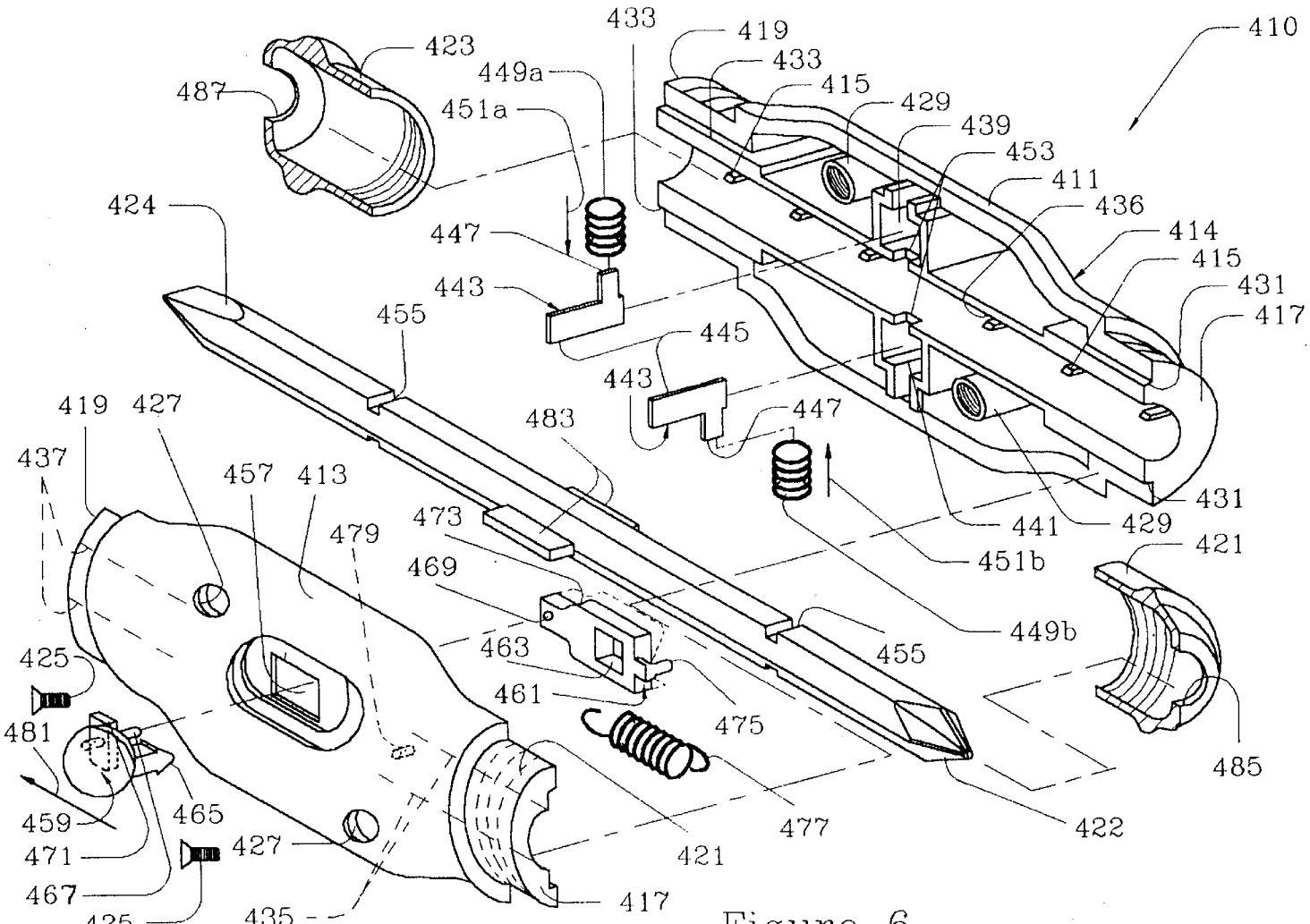
FIG. 6 is a exploded view of an alternate preferred embodiment of the present invention.

Referring to FIG. 6, an alternative preferred embodiment of the inventive multi-purpose tool is illustrated. Here tool 410 comprises a shaft 412 and a handle 414. Shaft 412 is preferably made of steel or other high tensile strength material. Shaft 412 has a hexagonal cross section.

Shaft 412 terminates in an end 422 configured as a Phillip's head screwdriver and a second contact end 424 configured as a flat head screwdriver tip.

Alternatively, various sized and types of screwdriver tips or other tools or mountings for tools may disposed at ends 422 and 424. For example, contact ends 422 and 424 may be configured as Allen wrench tips, star driver tips and or any other conventional driving mechanism or even an awl, spike or blade.

Handle 414 is comprised of a pair of handle portions 411 and 413. In order to facilitate ease of construction and assembly, handle portions 411 and 413 each define a side of handle 414 and are mirror images of each other. Handle portions 411 and 413 also define functional aspects of handle 414 and utility tool 410 when assembled.

As illustrated in FIG. 6, handle portions 411 and 413 are configured to define a central opening 436 when they are assembled about shaft 412. Central opening 436 runs completely through the center of handle 414. The periphery of central opening 436 is defined by a plurality of support struts 415.

Support struts 415 are configured and dimensioned to give central opening 436 a hexagonal cross sectional shape. Central opening 436 is slightly larger than shaft 412 thereby allowing handle 414 to be slidably mounted to shaft 412.

The positioning of central opening 436 and support struts 415 result in handle 414 being centered about shaft 412.

This configuration provides an optimum transfer of a torsional force from handle 414 to shaft 412 when said torsional force is applied by the hand or hands of a user to the handle 414. Similarly, a torsional force may also be applied by a wrench, pneumatic tool or other mechanical device.

In addition, the corresponding shape of opening 436 with respect to shaft 412 prevents wobbling of the shaft when in use.

Shaft 412 and central opening 436 may also be manufactured in other shapes such as a rectangle, triangle, star and/or Allen wrench type. These shapes will also provide an efficient transfer of force.

The surfaces of handle portions 411 and 413 are contoured to provide an optimal gripping surface. Handle 414 may also be configured with a grooves to improve the gripping surface of handle 414. Handle 414 may be manufactured out of a high strength plastic or any other easily molded material that provides a light weight durable construction.

Alternatively and for industrial uses, handle 414 may be constructed from super strong materials such as hardened steel.

Handle portions 411 and 413 terminate at a pair of circular end portions 417 and 419. Central opening 436 is centered on ends portions 417 and 419 and runs completely through handle 414. Central opening 436 has a periphery slightly larger that the periphery of shaft 412. This allows handle 414 to be slidably mounted over shaft 412. The positioning of central opening 436 also allows handle 414 to be centered on shaft 412.

A pair of end caps 421 and 423 are molded to be placed over circular end portions 417 and 419. This configuration supports the assembly of handle 414.

End caps 421 and 423 have an inside diameter slightly larger than the outside diameter of circular end portions 417 and 419. This allows end caps 421 and 423 to be placed over circular end portions 417 and 419. This feature helps maintain the integrity of handle 414 and provides for a convenient, efficient and simple assembly that may be utilized in an assembly line type construction. End caps 421 and 423 may be permanently affixed onto handle 414 by glue, welding, soldering and/or any other conventional securement.

Alternatively, circular end portions 417 and 419 may be configured with grooves to match an internally threaded end cap. This feature would allow for the threaded securement of end caps 421 and 423. As illustrated by the dashed lines in FIG. 6. This feature allows a user to removed end caps 421 and or 423 and remove shaft 412 to replace it with an alternative shaft having different sized driving tips.

In addition, end caps 421 and 423 and handle portions 411 and 413 may be manufactured out of rubber to provide durability and an electrically insulated tool.

Handle portions 411 and 413 are also affixed to each other by a pair of screws 425 which pass through a pair of openings 427 on handle portion 413 and into a pair of threaded cylinders 429 affixed to handle portion 411.

Handle portion 411 is also configured to have a pair of raised shoulder surfaces 431 and 433. Shoulder surfaces 431 and 433 are received into a pair of matching grooves 435 and 437 when handle portion 411 is affixed to handle portion 413 through the use of screws 425, and end caps 421 and 423. Thus, the positioning of shoulder surfaces 431 and 433 provide additional stability to handle 414.

Figure 7:
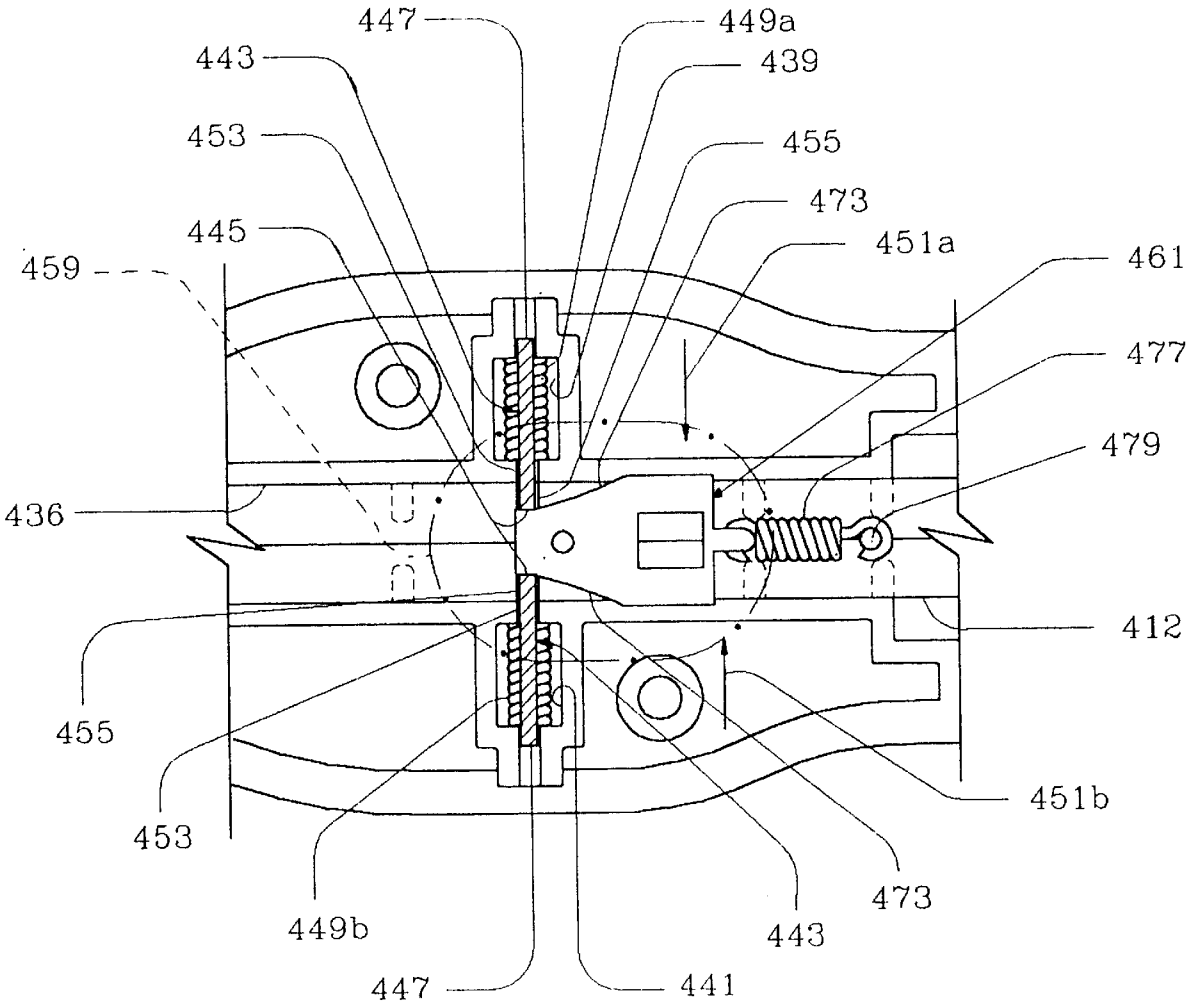
FIG. 7 is a cross sectional view of the release mechanism of the FIG. 6 embodiment.

Referring now to FIGS. 6 and 7, the locking mechanism of tool 410 is illustrated. Handle portion 411 has a pair of cavities 439 and 441 disposed of on the interior surface of handle portion 411. Cavities 439 and 441 are configured to receive and slidably support a pair of engagement members 443. Engagement members 443 are identical in shape and are configured to have a cam follower 445 and a driving end 447. Cam followers 445 extend outwardly from cavities 439 and 441 and into central opening 436.

A pair of springs 449*a* and 449*b* are also positioned and supported within cavities 439 and 441. Springs 449*a* and 449*b* are configured to be positioned over driving ends 447 of members 443.

In this configuration, springs 449*a* and 449*b* provide an urging force upon members 443 in the direction of their respective arrows 451*a* and 451*b*. Cavities 439 and 441 also have a pair slotted openings 453 which allow cam followers 445 to protrude out of cavities 439 and 441 into central opening 436 when members 443 move in the direction of arrows 451*a* and 451*b*. Cam followers 445 slide into a pair of engagement grooves 455 that are cut into the surface of shaft 412.

Engagement grooves 455 are positioned on opposite surfaces of shaft 412 and are also positioned at either end of shaft 412 to allow handle 414 to be locked upon shaft 412 to expose either contact end 422 or contact end 424.

Referring back now to FIG. 6, a release switch opening 457 is positioned on handle portion 413. Release switch opening 457 is configured to slidably support a release switch 459. Release switch 459 is affixed to a release mechanism 461.

Release mechanism 461 is positioned within handle 414 and acts to release cam followers 445 from engagement grooves 455.

Release mechanism 461 has a rectangular opening 463 positioned to receive a rectangular stub 465. Rectangular stub 465 protrudes from release switch 459 and extends inwardly. In addition, a pin 467 also protrudes from release switch 459 and extends inwardly. Pin 467 is made of metal and is received into an opening 469 on release mechanism 461. Rectangular stub 465 and pin 467 are used to rigidly secure release switch 459 to release mechanism 461.

A rectangular spacer 471 is also positioned on pin 467. Rectangular spacer 471 is configured to be slidably positioned within opening 457 so as to provide an even sliding movement and a sliding limit to release switch 459.

Release mechanism 461 is configured to have a pair of cam surfaces 473 and a hook 475. Hook 475 is affixed to one end of a spring 477 having its opposite end affixed to a pin 479 on handle portion 413.

Alternatively and as illustrated by the dashed lines of release mechanism 461, release mechanism 461 may be configured to have a V shaped or convex surface that faces shaft 412. This configuration would allow release mechanism 461 to wrap around shaft 412 providing for more uniform contact between cam surfaces 473 and cam followers 445. In addition, release mechanism may be configured to match the any surface or perimeter configuration of shaft 412.

Figure 8:
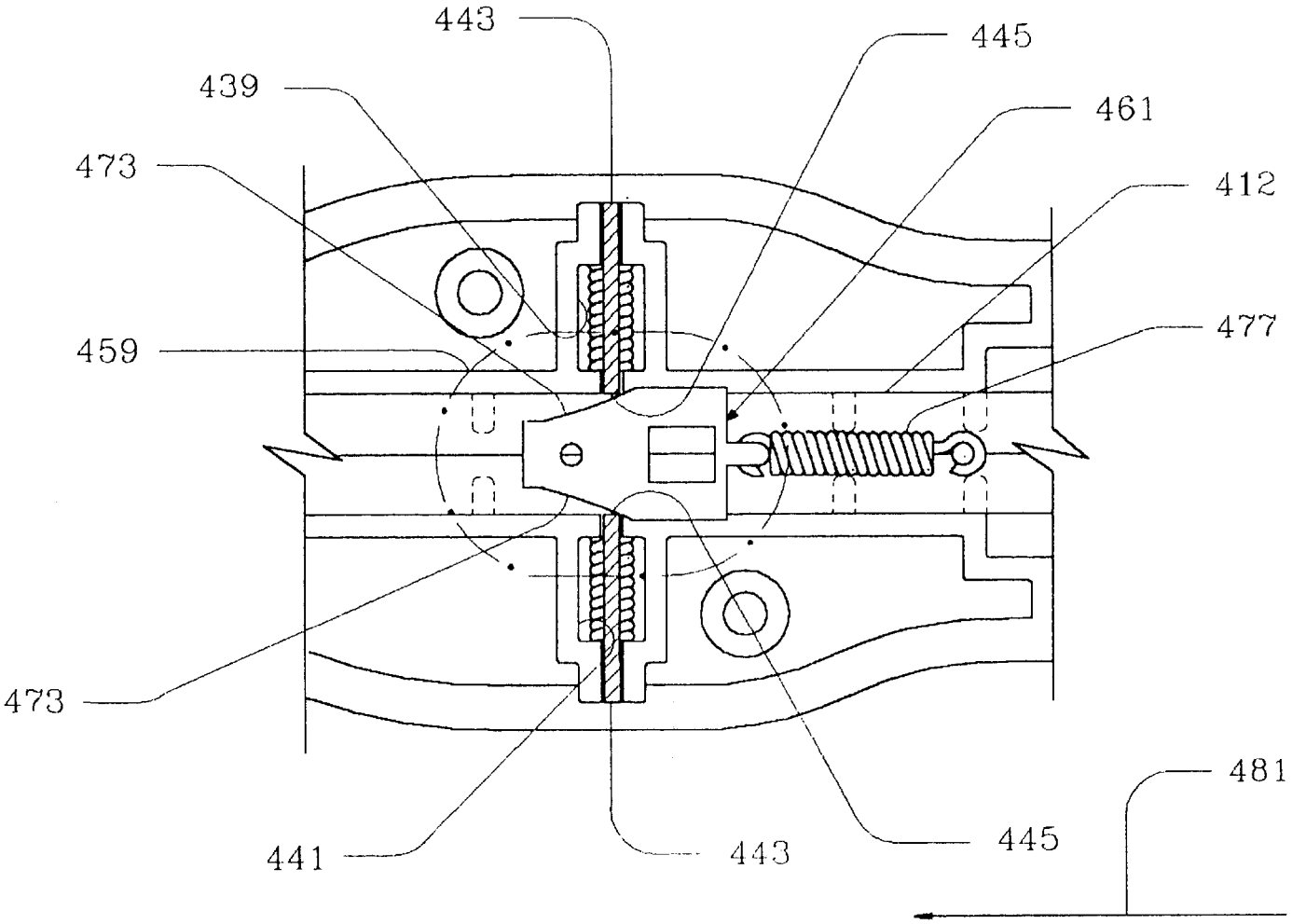
FIG. 8 is a cross sectional view illustrating the movement of the release mechanism of the FIG. 6 embodiment.

Referring now to FIGS. 7 and 8 the functional aspects of release switch 459 is illustrated. This assembly allows the user to slide release switch 459 in the direction of arrow 481 causing cam surfaces 473 to make contact with cam followers 445. As release mechanism 461 moves from the tool engaging position illustrated in FIG. 7 to the position where the tool shaft 412 is free to slide, as illustrated in FIG. 8, members 443 are forced back into cavities 439 and 441 causing cam followers 445 to become disengaged from shaft 412. In other words, once cam followers 445 are disengaged, handle 414 may now slide along shaft 412.

The positioning of spring 477 causes release switch 459 and release mechanism 461 to return to its original position as illustrated in FIG. 7 once the user applied force is removed from switch 459.

Handle 414 will now slide along shaft 412 until cam followers 445 of members 443 align with grooves 455. Once in this position cam followers 445 will be urged by springs 449 into grooves 455 causing handle 414 to once again be locked on shaft 412 as illustrated in FIG. 7.

To release this locking position a user may simply slide release switch 459 in the direction of arrow 481 until a force sufficient to overcome the urging force of spring 477 is reached. Once the urging force of spring 477 is overcome cam surfaces 473 will move in the direction of arrow 481. The configuration of opening 457 allows cam surfaces 473 to move in the direction of arrow 481 until cam followers 445 are retracted from grooves 455.

Once released, a user can slide shaft 412 through handle 414 or simply tilt tool 410 until gravity causes shaft 412 to slide through handle 414 until shaft 412 locks in its alternative locking position. This feature allows single hand operation of tool 410. This feature is of particular importance when a user is working from a ladder and/or scaffolding.

Referring back now to FIG. 6, release switch opening 457 and release switch 459 are countersunk so as to be positioned below the exterior surface of handle portion 413. This feature prevents inadvertent release of the locking mechanism while the utility tool 410 is being used.

This feature is of particular importance when the inventive tool is being used. The recessed feature of release switch 459 prevents inadvertent slippage of handle 414 on shaft 412 due to accidental unlocking of handle 414 from shaft 412. The recessed feature reduces the risk of this occurrence to almost zero probability.

A pair of tabs 483 are affixed to either side of shaft 412. Tabs 483 are positioned and configured to extend sufficiently away from the sides of shaft 412. The positioning of tabs 483 causes them to make contact with end cap 421 or 423 thereby preventing handle 414 from sliding completely off of shaft 412.

End caps 421 and 423 have openings 485 and 487 which are configured to be slightly larger than the periphery of shaft 412 without including tabs 483. This configuration allows handle 414 to slide along shaft 412 until tabs 483 make contact with opening 485 or 487.

Alternatively, handle portions 411 and 413 of handle 414 may configured to define openings 485 and 487.

Figure 9:
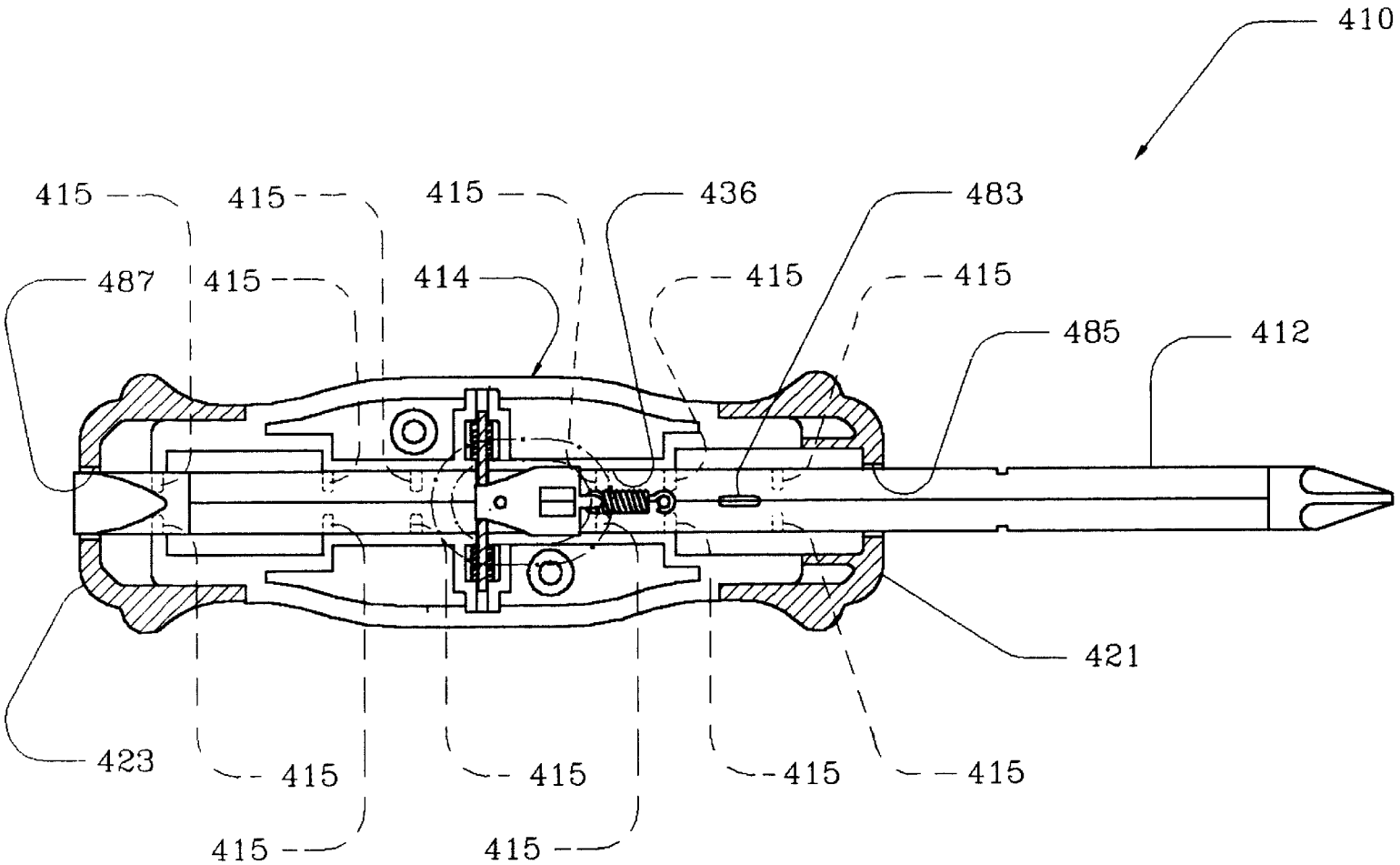
FIG. 9 is a cross sectional view of embodiment of the FIG. 8 of the preferred embodiment.

Referring now to FIG. 9, the positioning of support struts 415 is illustrated. Support struts 415 are positioned on the upper and lower surface of central opening 436. Support struts 415 have angled surfaces and are positioned to give central opening 436 a hexagonal configuration. The configuration of central opening 436 is configured to match the external configuration of shaft 412. The periphery of this configuration is slightly larger than the periphery of shaft 412. This allows handle 414 to be slidably mounted to shaft 412.

Moreover, the positioning of support struts 415 also defines a plurality of openings 489 between each pair of support struts 415. Openings 489 are configured to allow tabs 483 to slidably pass through. This allows tabs 483 to freely pass thorough handle 414 until they make contact with either end cap 421 or 423.

In addition, the corresponding shape of opening 436 with respect to shaft 412 and particularly tabs 483 provides additional stability to tool 410 and prevents wobbling of shaft 412 when in use.

Figure 10:
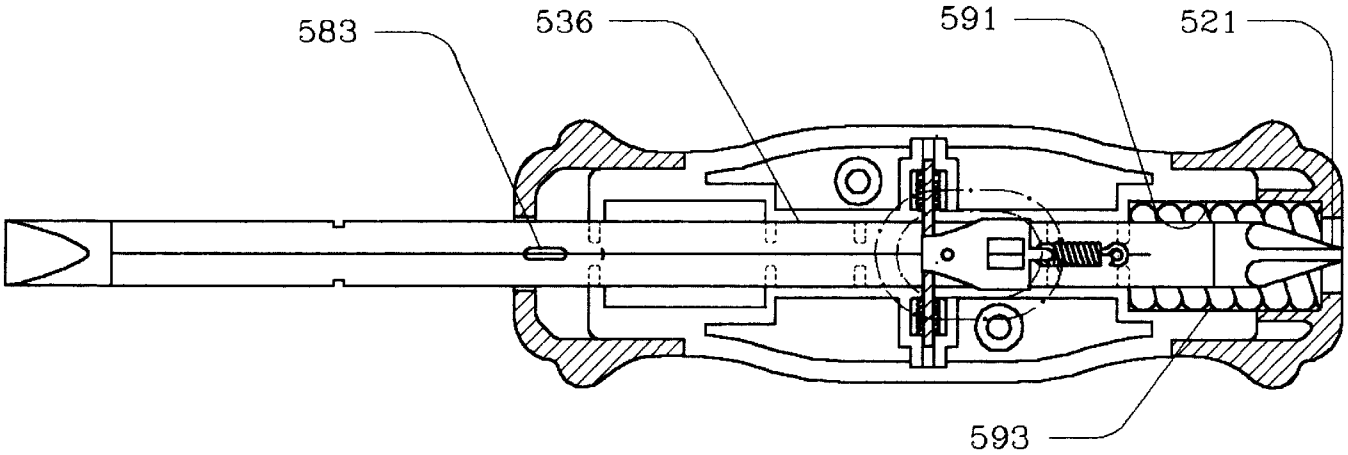
FIG. 10 is a cross sectional view of another alternative embodiment of the preferred embodiment.
Figure 11:
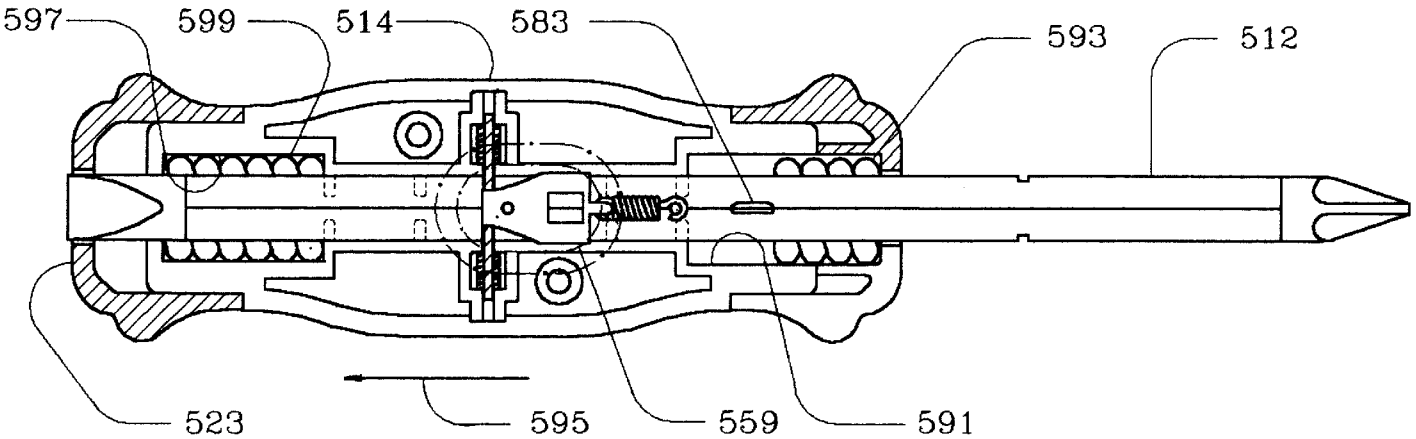
FIG. 11 is a cross sectional view of another alternative embodiment of the preferred embodiment.

Referring now to FIGS. 10 and 11, an alternative embodiment of the tool 410 is illustrated. Generally similar components and parts performing analogous, corresponding or identical functions to those of the FIG. 6 embodiment are numbered herein with numerals which differ from the FIG. 6 embodiment by multiples of one hundred.

Here central opening 536 and end caps 521 are configured to define an opening 591. Opening 591 is larger than central opening 536 and is configured to receive a release spring 593. The positioning of tabs 583 cause release spring 593 to make contact with end cap 521 and tabs 583 when the position of handle 514 is as illustrated in FIG. 11. This positioning causes spring 493 to become compressed creating an increased urging force in the direction of arrow 595.

This feature causes shaft 512 to automatically slide into he direction of arrow 595 when release switch is pushed in the direction of arrow 595 causing handle 514 to unlock from shaft 512.

Similarly, end cap 523 and central opening 536 may also be configured to define an opening 597. Opening 597 is configured to receive and support a second release spring 599. Release spring 599 reacts in a similar fashion to release spring 593. Thus, tool 510 may have a dual spring function or alternatively a single spring action.

Figure 12:
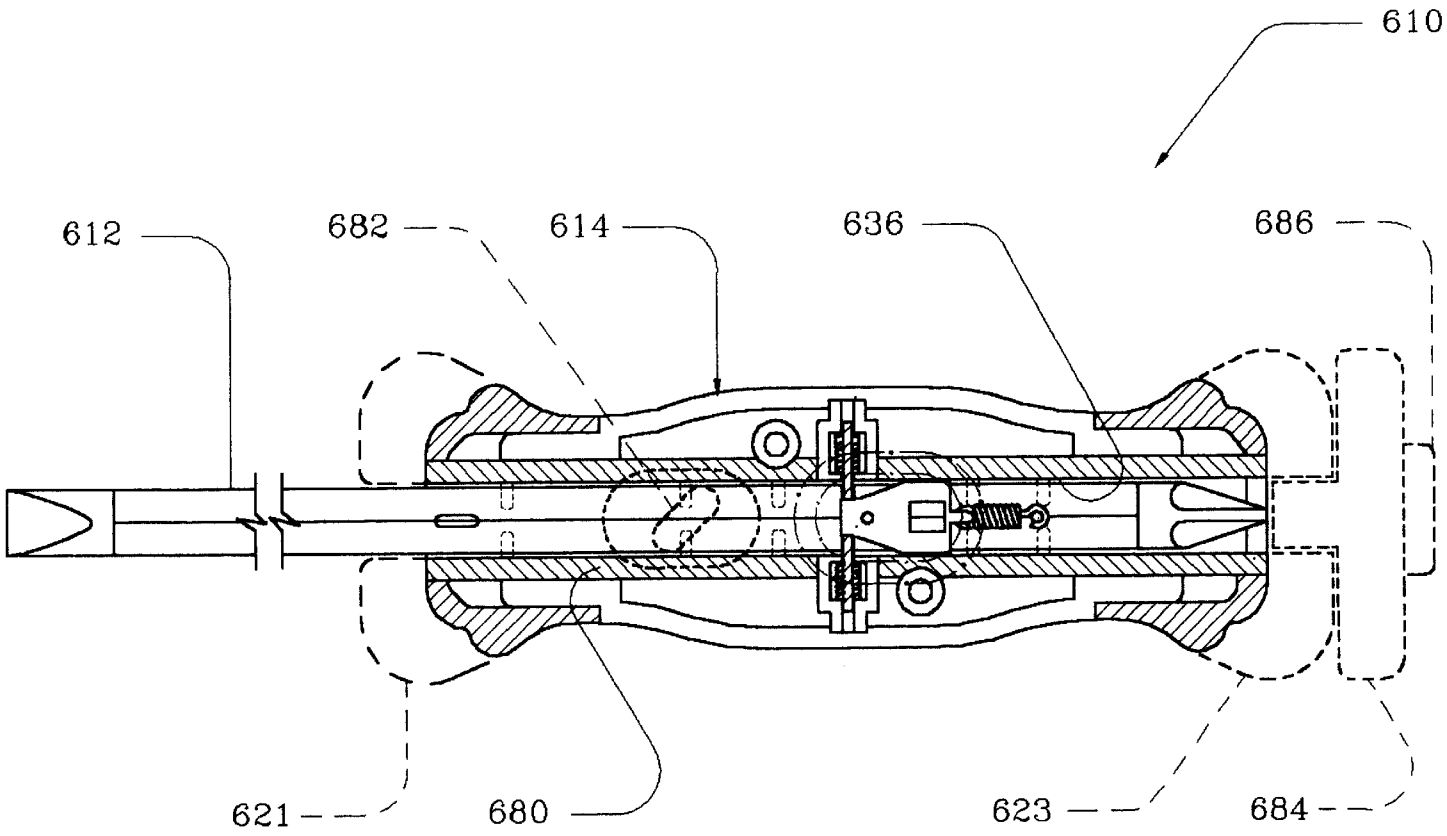
FIG. 12 is a cross sectional view of still another alternative embodiment of the preferred embodiment.

Referring to FIG. 12, yet another alternative embodiment of the inventive multi-purpose tool of FIG. 6 is illustrated. Here tool 610 also comprises a shaft 612 and a handle 614. In this embodiment central opening 636 is rotatably seated within handle 614 through the use of a rachet mechanism 680. Rachet mechanism 680 allows for a clockwise or counter clockwise rotation of central opening 636. A rachet engagement switch 682 determines the rotational movement of central opening 636. The positioning of rachet engagement switch 682 restricts or allows movement of rachet mechanism 680.

Alternatively and as illustrated in the dashed lines of FIG. 12, end cap 623 may be configured to receive a conventional rachet mechanism 684. Conventional rachet mechanism 684 providing an increased torsional force upon handle 614. Conventional rachet mechanism 684 may also be a pneumatically driven device.

Conventional rachet mechanism 684 also is equipped with a rachet engagement switch 686. Rachet engagement switch 686 restricting the rotational movement of rachet mechanism 682.

In addition and as illustrated by the dashed lines of FIG. 10, end cap 621 may also be configured to receive conventional rachet mechanism 684.

Figure 13:
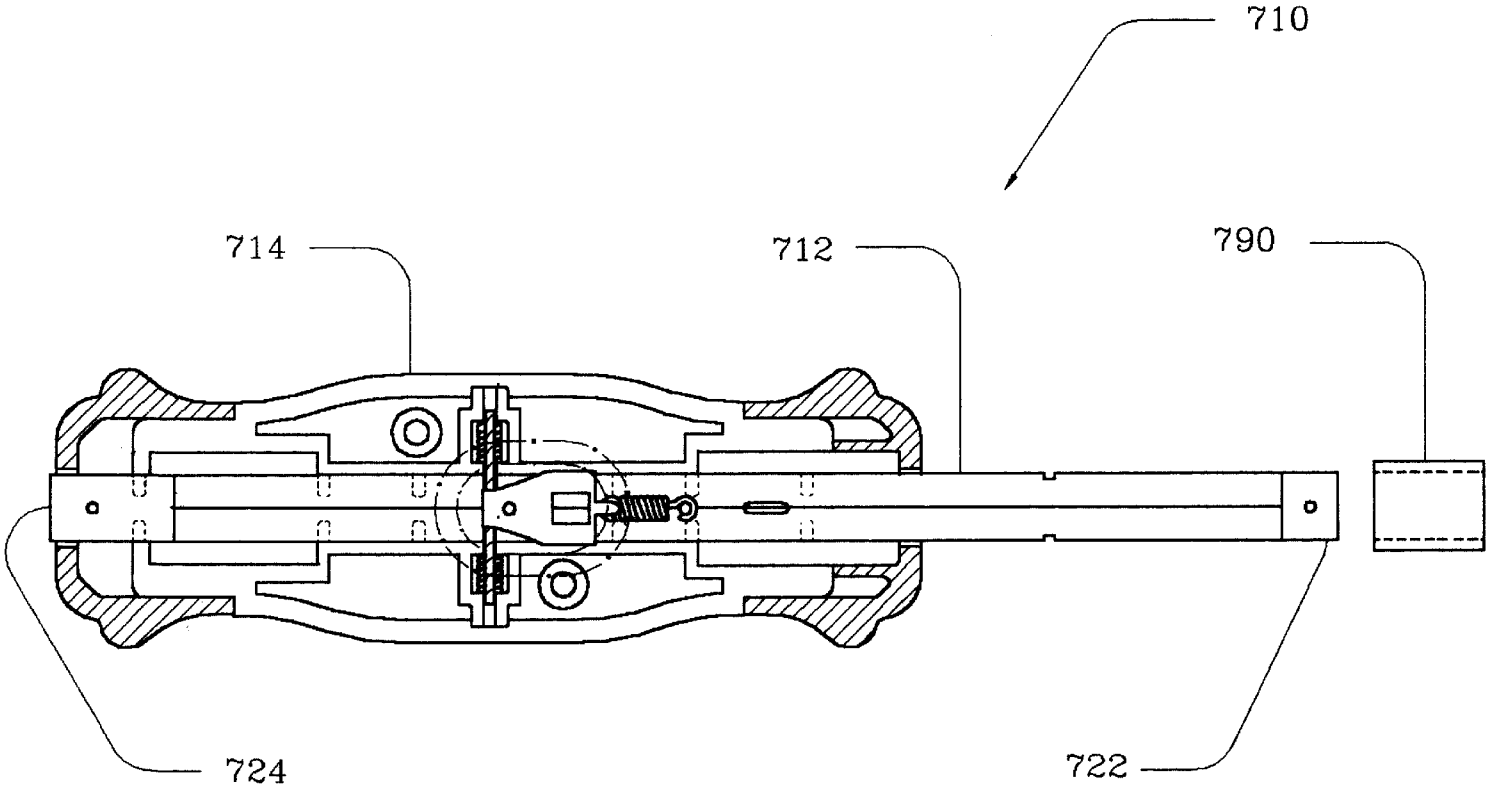
FIG. 13 is a cross sectional view of still another alternative embodiment of the preferred embodiment.

Referring to FIG. 13, yet another alternative embodiment of the inventive multi-purpose tool of FIG. 6 is illustrated. Here tool 710 also comprises a shaft 712 and a handle 714. In this embodiment contact ends 722 and 724 are socket shafts adapted for receiving a socket 790. Contact end 722 is configured to receive, hold and drive a quarter inch socket while contact end 724 is configured to receive, hold and drive a ⅜ inch socket.

Alternatively contact ends may be adapted for, larger and smaller socket sizes, each being sized to have the next size smaller or larger on the opposite contact end.

While an illustrative embodiment of the invention has described, various modifications will be obvious to those skilled in the art. Such modifications are within the spirit and scope of the present invention which is limited and defined only by the appended claims.

I claim:

1. A multi-purpose utility tool, comprising:

(a) a handle, having a centrally located opening;

(b) a shaft, having a first end and a second end, and being configured and dimensioned to be slidably positioned within said centrally located opening;

(c) a pair of locking members, being spring biased to extend into said centrally located opening;

(d) a first pair of recessed openings defined on said shaft, said recessed openings being positioned on said shaft, whereby said locking members protrude into said first pair of recessed openings when said shaft is in a first position and said pair of locking members secure said handle to said shaft;

(e) a second pair of recessed openings defined on said shaft, said second pair of recessed openings being positioned on said shaft, whereby said locking members protrude into said second pair of recessed openings when said shaft is in a second position and secure said handle to said shaft; and (f) a release mechanism being slidably secured to said handle and extending into said centrally located opening whereby the movement of said release mechanism causes said pair of locking members to be withdrawn from either said first or second pair of recessed openings thereby allowing said shaft to move freely within said centrally located opening.

2. A multi-purpose utility tool as in claim 1, wherein said first end of said shaft comprises a Phillip's head screwdriver tip and said second end of said shaft comprises a flat head screwdriver tip.

3. A multi-purpose utility tool as in claim 1, wherein said handle comprises a pair of handle portions defining said centrally located opening.

4. A multi-purpose utility tool as in claim 1, wherein said shaft further comprises a shaft stop member extending away from said shaft, said central opening of said handle and said handle being configured and dimensioned to allow said shaft and said shaft stop member to be slidably positioned within said first and second positions and said handle being configured dimensioned and positioned to prevent said shaft stop member from sliding out of said centrally located opening thereby preventing said shaft from sliding completely out of said handle.

5. A multi-purpose utility tool as in claim 4, wherein said pair of locking members are slidably secured within a pair of cavities within said handle, said pair of locking members being driven towards said shaft and into said central opening by a pair of springs seated with said cavities.

6. A multi-purpose utility tool as in claim 5, wherein said release mechanism has a pair of cam surfaces, said release mechanism being slidably secured within said handle and cooperating with an externally mounted release switch, said release switch being positioned so as to allow a user applied pressure to slide said release switch and said release mechanism, said user applied pressure causing said cam surfaces to engage said pair of locking members until an urging force sufficient to overcome said springs is reached thereby urging said pair of locking members out of either said first or second pair of recessed openings thereby allowing said shaft to slide within said handle.

7. A multi-purpose utility tool as in claim 1, wherein said first end of said shaft comprises a first end for receiving a first socket having a first sized dimension and said second end of said shaft comprises a second end for receiving a second socket having a second sized dimension.

8. A multi-purpose utility tool as in claim 4, wherein, said handle is configured to receive a mechanical ratchet for providing a larger torsional force upon said handle.

9. A multi-purpose utility tool as in claim 6, wherein said release mechanism further comprises a spring, said spring providing an urging force for urging said cam surfaces away from said engaging members when said user applied force is removed.

10. A multi-purpose utility tool as in claim 6, wherein said said handle is chamfered around said externally mounted release switch.

11. A multi-purpose utility tool, comprising:

(a) a handle, defining a centrally located opening;

(b) a shaft, having a first end and a second end and being configured and dimensioned to be slidably positioned within said centrally located opening;

(c) a pair of engaging members being configured, dimensioned and positioned to be spring biased into said centrally located opening;

(d) a first pair of recesses defined in said shaft, said first pair of recesses being configured and dimensioned to receive and engage said pair of engaging members when said shaft is in a first position whereby said handle is secured to said shaft exposing said first end for use while said second end is secured within said handle;

(e) a second pair of recesses defined in said shaft, said second pair of recesses being configured and dimensioned to engage said pair of engaging members when said shaft is in a second position whereby said handle is secured to said shaft while exposing said second end for use while said first end is secured within said handle;

(f) a pair of end caps positioned at either end of said centrally located opening, said end caps limiting the size of said centrally located opening; and (g) a stopping member extending outwardly from said shaft, said stopping member being configured and dimensioned to allow said shaft to be slidably positioned between a pair of limits defined by the distance between said pair of end caps said pair of limits including said first and second positions; and h) a means for urging said engaging members from either said first or second pairs of recesses.

12. A multi-purpose utility tool as in claim 11, wherein said end caps are disposed on either end of said handle, each of said end caps having an opening, said openings being substantially aligned with said central opening and sized to allow said shaft to slide through said openings, said openings are of a size substantially large enough to allow said shaft to slide through but not said shaft stop member.

13. A multi-purpose utility tool as in claim 11, wherein said stopping member comprises a pair of tabs extending laterally away from said shaft.

14. A multi-purpose utility tool as in claim 12, wherein said stopping member comprises a pair of tabs extending laterally away from said shaft.

15. A multi-purpose utility tool as in claim 14, wherein said openings of said end caps are sized to receive and support a pair of springs, said springs being configured, dimensioned and positioned so as to provide an urging force upon said tabs urging said shaft towards said first or second position when said engaging members are withdrawn from either said first or second pair of recesses.

16. A multi-purpose utility tool, comprising:

(a) a handle, defining a centrally located opening, said opening passing longitudinally through said handle;

(b) a shaft, having an upper surface, a lower surface, a first end and a second end and being configured and dimensioned to be slidably positioned within said centrally located opening;

(c) a pair of engaging members being configured, dimensioned and positioned to be spring biased into said centrally located opening from a position remote from said centrally located opening;

(d) a first pair of recesses, one of said first pair of recesses being defined in said upper surface of said shaft and the other being defined in said lower surface of said shaft, said first pair of recesses being configured, dimensioned and positioned to receive and engage said first pair of engaging members when said shaft is in a first position whereby said handle is secured to said shaft exposing said first end for use while said second end is secured within said handle;

(e) a second pair of recesses, one of said second pair of recesses being defined in said upper surface of said shaft and the other being defined in said lower surface of said shaft, said second pair of recesses being configured, dimensioned and positioned to receive and engage said pair of engaging members when said shaft is in a second position whereby said handle is secured to said shaft exposing said second end for use while said first end is secured within said handle;

(f) a release mechanism having a pair of cam surfaces, said release mechanism being slidably secured within said handle and cooperating with an externally mounted release switch, said release switch being positioned so as to allow a user applied pressure to slide said release switch and said release mechanism, said user applied pressure causing said cam surfaces to engage said pair of engaging members until an urging force sufficient to overcome the spring biasing of said members is reached thereby urging said engaging members out of either said first or second pair of recesses openings thereby allowing said shaft to slide within said centrally located opening.

17. A multi-purpose utility tool as in claim 16, wherein said shaft is hexagonal in configuration.

18. A multi-purpose utility tool as in claim 17, wherein said engaging members are configured, dimensioned and positioned to have a portion extending outwardly from said shaft and said release mechanism having a recessed portion, said recessed portion being in a facing spaced relationship with respect to said shaft allowing said cam surfaces to make contact with said portion of said locking members extending outwardly.

19. A multi-purpose utility tool as in claim 16, wherein said release mechanism further comprises a spring, said spring providing an urging force for urging said cam surfaces away from said engaging members when said user applied force is removed.

* * * * *